US005566410A

United States Patent [19]

Schaechter

[11] Patent Number: 5,566,410

[45] Date of Patent: Oct. 22, 1996

[54] QUICK SEAL PILLOW COVER CONFIGURATION AND METHOD

[76] Inventor: Alan L. Schaechter, P.O. Box 401, Valley Stream, N.Y. 11582

[21] Appl. No.: 328,092

[22] Filed: Oct. 24, 1994

[51] Int. Cl.[6] ..... A47G 9/00

[52] U.S. Cl. ..... 5/490; 5/923

[58] Field of Search ..... 5/485, 490, 636, 5/923

[56] References Cited

U.S. PATENT DOCUMENTS

| | | | |
|---|---|---|---|
| 834,643 | 10/1906 | Schnadig | 5/490 |
| 3,242,511 | 7/1963 | Fultz et al. | 5/490 |
| 3,267,496 | 8/1966 | Gionet | 5/490 |
| 4,144,603 | 3/1979 | Schaechter | 5/339 |
| 4,193,152 | 3/1980 | Seibold, Jr. | 5/490 |
| 4,768,247 | 9/1988 | Beier | 5/636 |
| 4,959,880 | 10/1990 | Tesch | 5/636 |

FOREIGN PATENT DOCUMENTS

| | | | |
|---|---|---|---|
| 1038549 | 9/1953 | France | 5/490 |
| 26854 | 12/1903 | United Kingdom | 5/490 |
| 0007738 | 3/1912 | United Kingdom | 5/490 |
| 0634023 | 2/1949 | United Kingdom | 5/490 |
| 721032 | 12/1954 | United Kingdom | 5/490 |

*Primary Examiner*—Steven N. Meyers
*Assistant Examiner*—Robert G. Santos
*Attorney, Agent, or Firm*—Sherman and Shalloway

[57] ABSTRACT

A quick sealing pillow cover, which is an improvement over U.S. Pat. No. 4,144,603, is provided with retainer portions in the one open edge and hook and loop closure, such as Velcro, on the inside flaps of the opening forming the open edge. Quick sealing is accomplished merely by, simultaneously pulling the corners of the retainer portions on the side with the opening in opposite directions with just one snap of the wrists. The pillow is retained in the cover without slipping out even during vigorous physical activity by the user. With the pillow removed and the pillow cover sealed, the hook and loop closure means provides sufficient rigidity to the pillow cover that the physical symmetry of the pillow cover during washing and drying or cleaning cycles is maintained and the cover may be reused without pressing (ironing) or folding.

3 Claims, 1 Drawing Sheet

QUICK SEAL PILLOW COVER CONFIGURATION AND METHOD

FIELD OF INVENTION

The invention relates to an improvement of my U.S. Pat. No. 4,144,603 which is directed to a method of retaining a pillow in a pillow cover without the use of any closure means by the use of retainer portions formed in the open side of a rectangular pillow cover having three closed sides and an open side along the length of the cover. It has been found that by adding a hidden strip of hook and loop closure means on the inside flaps of the opening on the length of the pillow cover described in U.S. Pat. No. 4,144,603, the pillow cover can be quickly sealed by pulling the corners of the retainer portions on the side with the opening in opposite directions with just one snap of the wrists.

PRIOR ART

Conventional pillow covers are, of course, well known. Usually, these pillow covers are formed with three sides closed and with the fourth side entirely open. A pillow is inserted through the opening which is Usually on the short side or width of the pillow cover and usually conforms to the depth of the pillow.

In the course of the use of the pillow and pillow cover, the pillow tends to slip Out. This is particularly true when the materials of the pillow and cover are fine and smooth.

To overcome this problem, various types of fasteners have been used with the open side of the pillow cover, including zippers, buttons, laces, eye hooks, etc., as well as releasable fasteners, such as Velcro brand hooks and loops as described in U.S. Pat. No. 5,084,928 to Skillington. It should be noted that U.S. Pat. No. 5,084,928 uses two very small pieces of hook and loop closure to close what may be described as a conventional pillow cover for use with a pillow of larger dimensions than the cover.

The invention of U.S. Pat. No. 4,144,603 overcame these deficiencies by providing a method of retaining the pillow in the pillow cover which comprises forming a rectangular pillow cover which is closed on three sides and has an opening extending along the fourth side, partially closing said fourth side at the edges of the opening to form retainer portions which will contain the pillow in the cover. The retainer portions are formed along a prescribed distance in relation to the length of the fourth side to permit insertion of the pillow in the cover while retaining the pillow in the cover when the pillow is thereafter symmetrically oriented in the pillow cover.

In order to overcome certain disadvantages and provide additional advantages to the user of the above-described method, it has been found that the addition of a hidden continuous strip of hook and loop closure means on the inside flaps of the opening of the fourth side of the pillow cover, said strips being placed about 2 ¼ inches down from the top of the opening and centered between the retainer portions for more than 50% of the length of the pillow cover will accomplish these ends. The invention provides a method to quickly seal the pillow cover when first inserting a pillow therein or replacing the pillow cover, for example, after the washing and drying or cleaning cycles.

SUMMARY OF INVENTION

It is an object of my invention to provide a method for quickly sealing a pillow cover when replacing the pillow in the pillow cover after the cover has been washed and dried or cleaned by simultaneously pulling on the retaining corners of the partially open side in opposite directions thereby causing the opening to immediately seal closed with just one snap of the wrists.

It is another object of my invention to provide a method whereby the opening and flaps are closed and unseen during use which allows for a neater appearance while also improving pillow retention by preventing the pillow from slipping out of the cover during vigorous physical activity by the user.

It is a further object of my invention to provide a method of releasably sealing the pillow cover by means of hidden continuous hook and loop strips which covers more than 50% of the length of the pillow to help to maintain the physical symmetry of the pillow cover during the washing and drying or cleaning cycles and allowing the cover to be used without pressing or folding of same.

Another object is to provide a method of quickly sealing the opening to secure the pillow within the cover and thereby preventing hands and other objects from catching or getting caught in the opening during the user's sleep cycle.

A further feature of the invention is to provide a pillow cover which can be quickly sealed to form a sealed compartment within the cover which may be utilized for storing pajamas or sleep wear during the day or non-sleep cycle.

DETAILED DESCRIPTION

Figure 1:
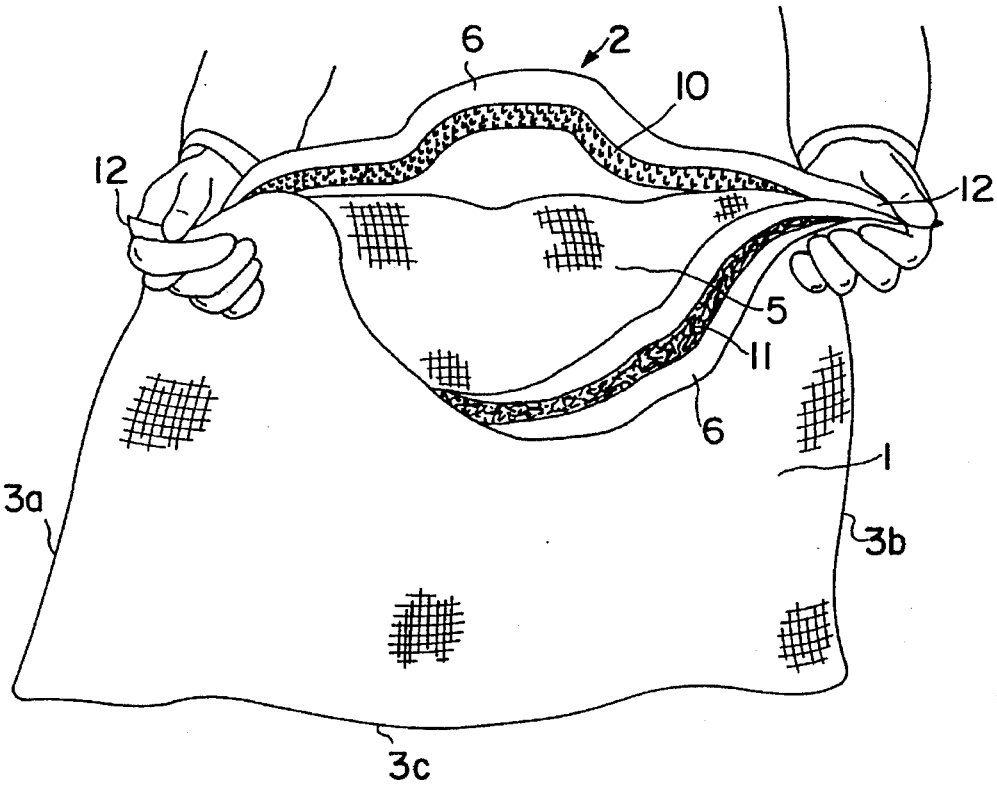
FIG. 1 is a front prospective view of the pillow cover according to the invention showing the cover held in the partially opened position with the pillow contained therein.
Figure 2:
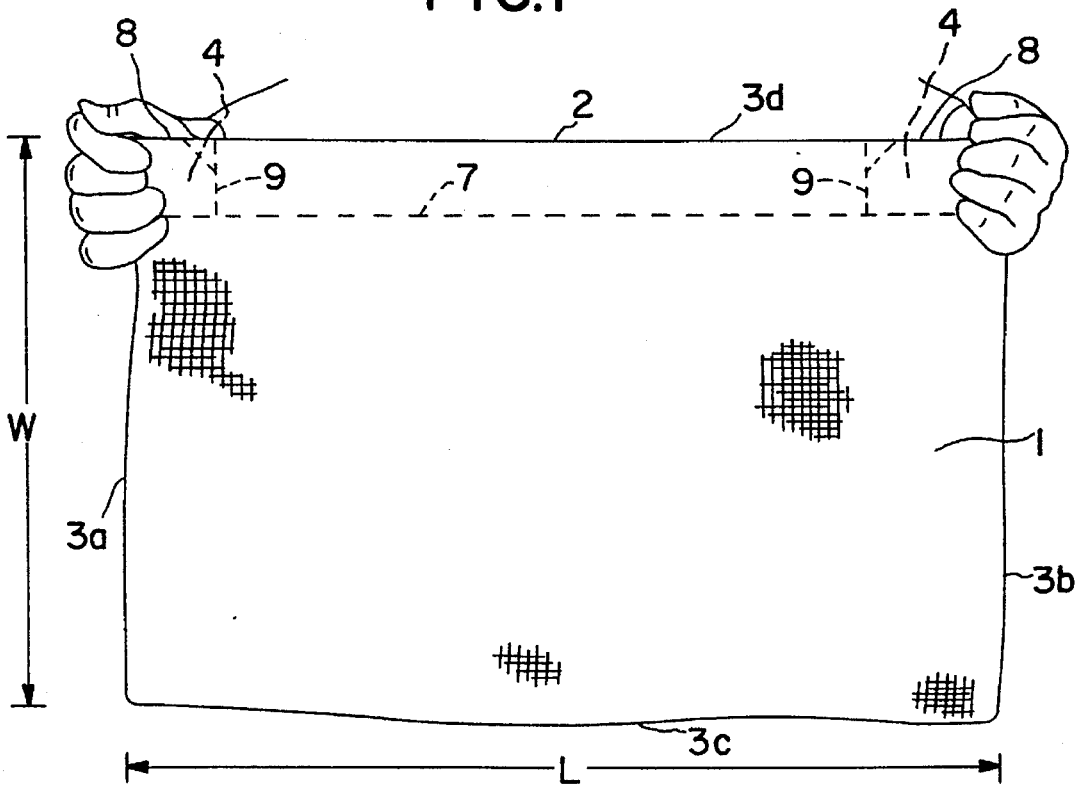
FIG. 2 shows the pillow cover after having been quickly sealed by simultaneously pulling the retaining corners of the partially open side in opposite directions.

Referring to the drawings there is seen in FIG. 1 a pillow cover 1 of rectangular form having a length L and width W as seen in FIG. 2.

FIG. 1 also shows a resiliently compressible rectangular pillow 5 inserted in the pillow cover 1. The pillow 5 may be standard, king or queensize or any other size providing the pillow 5 has somewhat smaller dimensions than the pillow cover 1. The cover 1 has an opening 2 along one long side 3*d* of its rectangular shape with the other three sides 3*a*, 3*b* and 3*c* being permanently sealed. Although less preferred, it is also within the scope of the invention to have an open short side, for example, 3*a*, open and the other three sides 3*b*, 3*c* and 3*d* permanently sealed.

As shown in FIG. 1 and FIG. 2 retainer portions 4 are formed along both edges 12 of the opening 2. As further described in my U.S. Pat. No. 4,144,603 these retainer portions 4 are formed by folding into the cover 1 the flaps 6 of the opening 2 and securing the flaps 6 to the inside of the cover 1 by stitching means 7 which are not visible on the outside of the cover 1. The retainer portions 4 are further formed by permanently stitching at the top edge at the corner 8 and at a vertical line 9 at each edge of the opening 2 at the juncture of the retainer portion 4. Each retainer portion 4 represents about 5% to 20% of the total length of the fourth side of the cover 1.

In accordance with the invention, a continuous strip of hook and loop closure means 10, 11 is placed inside the flaps 6 and centrally located between the retainer portions 4 and in close proximity to the edges of the opening 2.

As shown in FIG. 1, the hook portion 10 of the releasable closure means is attached to the inside of one flap 6 and the loop portion 11 is attached to the inside of the opposite flap 6. Each strip of hook and loop Closure means 10, 11 should be for the total length of the opening 2 between the retaining portions 4 but at least more than 50% of the total length L (or W) of the fourth side of the pillow cover 1.

The pillow 5 shown in FIG. 1 must be smaller than the cover 1 with the preferred dimensions being not more than 80% to 95%, respectively, of the length L and width W of the cover 1. Most preferably, the length of the side of the pillow parallel to the opening 2 is greater than the length of the opening, i.e. between vertical seam lines 9. FIG. 1 shows the pillow 5 inserted in the cover 1 with the cover 1 positioned to be quickly sealed at the opening 2 of the fourth side of the cover 1. The cover 1 is sealed by the closure means 10, 11 by holding the retainer portions 4 and pulling outwardly in opposite directions.

This simultaneous opposite pull of the wrists encloses the pillow 5 within the cover 1 and provides a covered pillow 5 where the opening 2 and flaps 6 are unseen, thereby allowing for a neater appearance while improving pillow retention by not allowing the pillow to slip out during vigorous activity by the user.

FIG. 2 shows the pillow cover in the closed position without the pillow 5 contained therein. The sealing of the cover 1 by the hook and loop closure means 10, 11 prior to submitting to wash and dry cycles prevents the closure means from snagging or catching other items, and also provides a certain stiffness to the pillow cover 1 which allows the cover to come out of the wash and dry cycles with a neat and pressed appearance.

Because the sealed pillow cover is larger than the pillow sealed therein, there is often sufficient room to use the extra space (volume) to store pajamas or other bed clothes in the pillow cover together with the pillow. Thus, during the day or non-sleep cycle, the pillow cover may be opened by pulling on the flaps 6 to disengage the hook and loop closure means and pajamas or other sleepwear may be inserted for storage in the pillow cover which may remain open or be closed as previously described. The bed wear may then be easily removed for use at the appropriate time.

It is intended that the scope of the invention be defined by the claims appended hereto and their equivalents.

I claim:

1. A quick-sealing method of enclosing a pillow in a pillow cover comprising providing a rectangular pillow cover closed on three sides with an opening extending along the length of the fourth side, partially permanently closed along said fourth side at the edges of the opening to form retaining portions each representing about 5% to 20% of the total length of said fourth side of the pillow cover to permit insertion of a pillow through the opening, the open portion of said fourth side having attached thereto a continuous strip of hook and loop closure means centrally located on the inside of the flaps between the retaining portions of the pillow cover, said hook portion of said closure means being on one flap in close proximity to the edge of the cover opening and said loop portion being on the other flap in close proximity to the other edge of the cover opening, thereby allowing the pillow to be easily inserted within the pillow cover, inserting a rectangular pillow through said opening between said retaining portions, said pillow having a length and width slightly smaller than the length and width of the pillow cover, and quickly sealing the pillow within the pillow cover by pulling outwardly in opposite directions on each corner of the retaining portions on the fourth side of the pillow cover.

2. A method as in claim 1 wherein the hook and loop closure means is placed on the flaps about 2¼ inches from the edge of the opening.

3. A method as claimed in claim 1 wherein the pillow has a length and width representing about 80% to 95% of the length and width of the pillow cover.

* * * * *